US006834457B1

(12) United States Patent
Warren

(10) Patent No.: US 6,834,457 B1
(45) Date of Patent: Dec. 28, 2004

(54) TACTICAL SIGHT FOR A SEMI-AUTOMATIC HAND GUN

(76) Inventor: Scott M. Warren, 15702 Beacon Ct., Montclair, VA (US) 22026

( * ) Notice: Subject to any disclaimer, the term of this patent is extended or adjusted under 35 U.S.C. 154(b) by 0 days.

(21) Appl. No.: 10/228,100

(22) Filed: Aug. 27, 2002

(51) Int. Cl.[7] ..... F41G 1/08
(52) U.S. Cl. ..... 42/141; 42/133
(58) Field of Search ..... 42/133, 111, 144, 42/145, 141; D22/109

(56) References Cited

U.S. PATENT DOCUMENTS

| | | | | |
|---|---|---|---|---|
| 1,363,553 | A | | 12/1920 | Barringer |
| D273,217 | S | | 3/1984 | Swenson |
| D296,227 | S | | 6/1988 | Novak |
| D301,512 | S | * | 6/1989 | Novak ..... D22/109 |
| D305,146 | S | | 12/1989 | Novak |
| D305,561 | S | | 1/1990 | Novak |
| D315,776 | S | * | 3/1991 | Novak ..... D22/109 |
| D351,449 | S | * | 10/1994 | Dagley ..... D22/109 |
| 5,822,872 | A | | 10/1998 | Waki |
| D403,734 | S | * | 1/1999 | Kay ..... D22/109 |
| 6,035,539 | A | | 3/2000 | Hollenbach et al. |
| D432,618 | S | * | 10/2000 | Wilson ..... D22/109 |
| D436,393 | S | | 1/2001 | Ling, Jr. |
| 6,216,351 | B1 | | 4/2001 | Flubacher et al. |

OTHER PUBLICATIONS

*Wilson Combat* 2001 Master Catalog, cover and selected pp. 71–73.

* cited by examiner

*Primary Examiner*—Stephen M. Johnson
(74) *Attorney, Agent, or Firm*—Fay, Sharpe, Fagan, Minnich & McKee

(57) ABSTRACT

A rear tactical sight for a semi-automatic handgun having a barrel and a slide which moves relative to the barrel rearwardly in a cocking direction to extract and eject a spent cartridge and cock the hammer and then forwardly in a chambering direction to strip, feed and seat the next round. The sight comprising a base extending in a longitudinal direction parallel to the cocking and chambering directions and having a back facing the cocking direction, a front facing the chambering direction, sides extending between the front and the back and a dovetail for interengaging a dovetail cut in the slide. The sight further including an upwardly open notch joined to the base, which partially defines boundaries of a sight line for the gun sight and a pair of inwardly tapered side walls extending upwardly from the base on either side of the sight line. The forwardly facing surfaces of the side walls including a slide securing surface or cocking surface for cycling the slide of the handgun with only one hand. The outer configuration of the tactical sight providing a contoured and reduced sight barriers, that direct the user's eye quickly to the front sight and allow for quicker target acquisition.

16 Claims, 5 Drawing Sheets

TACTICAL SIGHT FOR A SEMI-AUTOMATIC HAND GUN

INCORPORATION BY REFERENCE

The present invention relates to a gun sight for a semi-automatic handgun for tactical applications. Such gun sights are known in the art and are generally shown and described in Flubacher U.S. Pat. No. 6,216,351 which is incorporated by reference herein as background information illustrating a front and rear sight for a semi-automatic handgun including the interengagement between the sight and the slide of the handgun. Barringer U.S. Pat. No. 1,363,553; Waki U.S. Pat. No. 5,822,872 and Hollenbach U.S. Pat. No. 6,035,539 are incorporated by reference herein as background information showing different rear sight configurations along with the interactions between the front and rear sights. The Novak U.S. Pat. No. Des. 305,561; U.S. Pat. No. Des. 296,227; U.S. Pat. No. Des. 305,146; U.S. Pat. No. Des. 315,776 and U.S. Pat. No. Des. 301,512, Ling, Jr. U.S. Pat. No. Des. 436,393 and Swenson U.S. Pat. No. Des. 273,217 are incorporated by reference herein as background information illustrating rear tactical sights, and the dovetail, dovetail cut connection between the rear gun sight and the slide of the handgun.

Also incorporated by reference herein as background information illustrating tactical gun sights is the cover and several selected pages from *Wilson Combat* 2001 Master Catalog. The *Wilson Combat* catalog illustrates several tactical gun sights along with the mechanical structure of the semi-automatic handgun.

The present invention relates to the art of gun sights and, more particularly, to a gun sight for a semi-automatic handgun used for tactical applications, where quick target acquisition and quick sight alignment are critical and wherein the sight is subjected to many adverse conditions and situations.

BACKGROUND OF THE INVENTION

The present invention is particularly applicable for use in connection with semi-automatic handguns, which are used for tactical applications, and, therefore, the invention will be described with particular reference to tactical semi-automatic handguns. However, the invention has broader applications and may be used with any type of semi-automatic handguns and other firearms. It is, of course, well known that a sight is necessary to accurately aim the barrel of a firearm that is being fired. It is also well known, proven and taught in tactical training, that use of any firearm in tactical applications necessitates quick threat or target acquisition and quick sight alignment. Furthermore, quick threat or target acquisition and quick sight alignment are also important when moving the firearm from a first target to a second target. It should be appreciated that in tactical situations, when lives are at stake, minimizing the time necessary to obtain a target or threat and align the sights are critical.

Traditional rear sights are typically square, boxy and include sharp corners. As a result, when utilizing a traditional rear sight, due to it's large top edge, the user's eye must search along that large top edge of the sight blade to locate the front sight. This lengthens time necessary to locate the front sight. In addition, the large rectangular rear portion of prior art gun sights acts as an obstruction, which reduces the ability to see the threat about the peripheral portions of the sight. When handguns are fired, typically at an arm's length from the user, a large bulky rear sight reduces the ability to fully see the target, especially when it is small and/or distant or when the user needs to distinguish if the threat is armed. In this respect, large boxy rear sight configurations may make it necessary for the user to actually lower the handgun so that the user can see over the top of the sights for target acquisition and then raise the handgun to align the sights. This, in addition to the user searching a large top edge of the sight to locate the front sight, takes significant time under tactical, life threatening circumstances and therefore disadvantageously increases the time necessary for target acquisition and sight alignment. Prior art gun sights also include eye distracting configurations and textures on the rear facing surface of the sight which produces time consuming distractions to the user's eye. In this respect, sharply square outer corners have a tendency to draw the user's eye to the corners of the gun sight, momentarily distracting the user, while the user is attempting to locate the front sight and align it in the notch of the rear sight. Textures and other configurations or contours on the rear surface of the sight have a similar effect. While some prior art sights such as Swenson, utilize textures to reduce glare, the textures tend to produce an eye distraction, disadvantageously increasing the threat acquisition time and sight alignment time.

The notch of the rear sight is used to define the boundaries of a sight line, which in connection with the front sight, allows the user to properly align the barrel towards the target. Prior art notches fall in two general categories, namely, semi-circular notches and rectangular notches. Semi-circular notches are difficult to align since there are no sidewalls to reference against the sides of the front sight. The sidewalls of the rear notch are used as parallel references to the sides of the front sight to ensure that the handgun's barrel is properly aligned from left to right. This is done by having an equal open space between the left side edge of the front sight to the left side edge of the rear notch wall as between the right side edge of the front sight to the right side edge of the rear notch wall. With a semi-circle, proper alignment is not easily definable, since the front sight is referenced, to merely a portion of a round shape. However, while prior art rectangular notches provide better reference based on the side edges, it has also been found that square corners at the bottom of the notch detract the user's eye in that the eye is drawn to the sharp corners. As stated above, sharp corners momentarily distract the user eye, while the user is attempting to locate the front sight. This same distraction comes from looking through a notch with sharp bottom corners. Another problem with the prior art sight relates to the length of the notch. Notches which have a long length produce more of an obstruction to the sight line which increases the amount of time necessary for target acquisition and for finding the front sight. Turning to the width of the notch, rear notches which are substantially wider than the width of the front sight make it difficult to center the front sight within the notch which also adds to the time necessary for target acquisition.

Another aspect of tactical gun sights relates to the fact that these sights are often used in many different types of adverse conditions and situations. With respect to adverse conditions, while target or threat acquisition is important, the tactical gun sight must also be designed to withstand the harsh conditions in which the firearms are often used. More particularly, tactical handguns are designed for use by military and law enforcement personnel and other individuals in the field. This involves transporting the firearm and using the firearm over many uncertain terrains and in connection with many uncertain obstacles. Further, due to the adverse conditions, the firearm can be dropped and/or be engaged against the terrain and/or obstacles. As a result, the gun sight must be robust and accurately tied to the slide mechanism of the handgun to maintain accuracy.

Another adverse situation in the field relates to what is called a "stove pipe jam" (SPJ), which describes the situation wherein a spent case is extracted from the chamber, but the rim of the cartridge slips off the extractor hook and the cartridge does not make contact with the ejector. The cartridge typically ends up in a vertical position, resting on the top round in the magazine. In addition, while this is taking place, the slide continues to cycle and chambers the next round. The slide fails to complete it's full cycle because the, now vertical cartridge becomes lodged between the slide's breach face and the front of the slide's ejection port. Thus, the vertical cartridge resembles a "stove pipe." While firing, if a SPJ occurs, the user must dislodge or clear the spent cartridge to make the handgun operational. The SPJ is cleared by first positioning the user's weak hand fingers on top of the slide with the palm facing down so that the SPJ is between the user's hand and body. Next, with a rapid and forceful slapping motion, the user snaps the positioned hand towards their body so that the index finger or the palm of the hand engages the protruding portion of the SPJ cartridge, dislodging it. Once the cartridge has been dislodged, the slide automatically closes. The force or rapid motion generated to remove the SPJ inevitably causes the hand to make physical contact with the rear sight which can injure the user's hand. This necessitates that the rear sight, which is typically struck by either the index finger or the palm of the hand, be free of any sharp edges, which can cause injury. Once the SPJ has been cleared the user may need to cycle the slide manually. But typically, the slide under spring tension, will close automatically.

Even yet, another adverse situation in the field occurs when a round is not fully seated in the chamber by the forward action of the slide. The user must then forcefully push the slide forward to fully seat the round in the chamber. The most effective technique to push the slide forward is to use the palm of the user's weak hand and with a forceful strike, engage the rear surface of the slide. Accordingly, it is advantageous for the back surface of the rear sight to be flush or only slightly recessed from the back of the slide or injury to the palm of the hand could occur.

SUMMARY OF THE INVENTION

In accordance with the present invention, provided is a rear gun sight for use in connection with a tactical semi-automatic handgun which includes configurations that minimizes sight obstructions, that quickly directs and focuses the user's sight to the sight line and front sight and includes a slide securing surface that provides for a positive and safe cycling of the slide with a single hand.

More particularly, a sight according to the present invention is configured to maximize the visual ability of the user to see past the rear sight for both target acquisition and front sight location by minimizing the cross-sectional configuration of the sight. In this respect, a rear surface minimizing design is incorporated on either side of the notch. This minimizing design greatly reduces the visual obstructions near the notch, so that the user can more quickly obtain target acquisition. The user's vision is now directed by the flow of the minimizing design and the resulting narrowness of the sight top to the sight line and front sight. Essentially the upper portion of the gun sight contains only the notch.

In order to provide these advantages, a gun sight according to the present invention has a generally rectangular base portion transverse to the cocking or chambering direction of the firearm which extends between the front and the back of the sight. Extending upwardly from the base portion is a notch wall and two side walls on either side of the notch wall. The side walls and the notch walls have a back surface contiguous with the back surface of the base of the sight. However, as the side walls extend upwardly from the base, they first curve inwardly and then curve upwardly so that the width of the top portions of the walls are significantly narrower than the width of the sight base. This allows for a robust sight with minimal obstruction characteristics.

Another aspect of the present invention is that the sight is configured to quickly direct the user's eye to the sight line and the front sight, by eliminating eye distracting configurations such as square corners. In this respect, the rear surface of the sight includes rounded corners between the bottom of the base and the sides of the base. Furthermore, the inward curves of the minimizing design described above are similar to the corner curves between the base bottom and base sides. As a result, the portion of the rear surface of the sight corresponding with the base is essentially rectangular with four softly curved corners. In order to reduce glare on the rear surface of the sight, this surface is angled rearwardly from bottom to top. Unlike prior art sights, the rearward slant allows glare reduction without eye attracting grooves or contours. Since the notch, is centered horizontally in the notch wall, which is the narrowest portion of the gun sight, the user can quickly obtain sight acquisition and front sight location without searching a large top edge of the sight.

Yet, another aspect of the present invention is the notch configuration, which according to the present invention directs the user's eye to the sight line, the front sight and the target/threat, making sight alignment and target acquisition quicker. The notch includes vertical sides and a flat bottom, however, the bottom and the sides are joined by curved corners. By utilizing curved corners, the eye is not distracted by sharp corners. Furthermore, by using straight sides and bottom, the front sight can be more quickly aligned in the notch. The notch, is also slightly slanted downwardly from back to front to produce a clear and distinct bottom edge. A flat, or horizontal, notch bottom can appear blurry or not easily distinguishable.

Even yet, another aspect of the present invention is to further reduce sight obstructions by including a clearance groove or channel cut in line with but forward of the notch. The clearance grove is between the side walls described above. This minimizes the sight boundaries as the user is looking through the notch. To even further reduce sight boundaries, the length of the notch is shortened.

In accordance with another aspect of the present invention, the top surface of the sight is slightly angled from back to front and the front edges are softened or broken so, as to reduce the chance of injury when clearing a "stove pipe jam." In addition, the slightly angled top surface produces a clear and distinct top edge, the same as the bottom of the notch. A flat, or horizontally top can make the edges appear blurry or not easily distinguishable. Additionally, the top surfaces of the side walls are slightly angled from back to front to also produce distinct side edges for the same reasons just staged above. The slight angles on these three surfaces produce a distinct and crisp view of the rear sight surface, which aids the user in aligning the sights efficiently and defining the sight picture on the target or the threat.

Accordingly, an object of the present invention is the provision of a rear gun sight for a semi-automatic handgun which can be effectively used for tactical applications thereby allowing the user to quickly align the sights and obtain target acquisition.

Another object is the provision of a tactical sight of the foregoing character that is rugged and able to withstand use in many adverse conditions.

Still another object is the provision of a tactical gun sight of the foregoing character which includes an outer configuration that minimizes eye distraction, so that the user's vision is directed to the sight line and the front sight.

A further object is the provision of a tactical gun sight of the foregoing character wherein the rear notch is configured with vertical side surfaces and a horizontal base surface with arcuate corners between the surfaces to further reduce eye distractions and to direct the user's vision to upward, to the front sight.

Another object is the provision of a tactical gun sight of the foregoing character wherein the notch is slanted downwardly from back to front to produce a clear and distinguishable bottom notch edge.

Even yet another object is the provision of a tactical gun sight of the foregoing character wherein the top surfaces of the notch walls and outer sidewalls are slanted downwardly from back to front to produce a clear and distinguishable top sight edge.

Still another object is the provision of a tactical gun sight of the foregoing character wherein the rear surface of the sight includes no sharp corners or other configurations which distract the user's eye and is slanted rearwardly to reduce glare.

Still yet, a further object is the provision of a tactical gun sight of the foregoing character wherein the length of the notch is reduced and a clearance groove is provided to reduce sight barriers within the notch for quicker target acquisition and front sight location.

Even yet a further object is the provision of a tactical gun sight of the foregoing character which includes vertically extending side walls that have an outer surface with an inward taper to even further reduce the sight barriers for yet quicker target acquisition.

A further object is the provision of a tactical gun sight of the foregoing character, which includes an angled top surface for preventing injury to the user's hand when clearing a "stove pipe jam."

Yet, another object is the provision of a tactical gun sight of the foregoing character, which utilizes materials that are light weight yet rugged and which a finish can be applied which has non-glare characteristics that can withstand a harsh environment associated with the use of tactical firearms.

BRIEF DESCRIPTION OF THE DRAWINGS

The foregoing objects, and others, will in part be obvious and in part be pointed out more fully hereinafter in connection with a written description of preferred embodiments of the present invention illustrated in the accompanying drawings in which.

DESCRIPTION OF THE PREFERRED EMBODIMENTS

Figure 1:
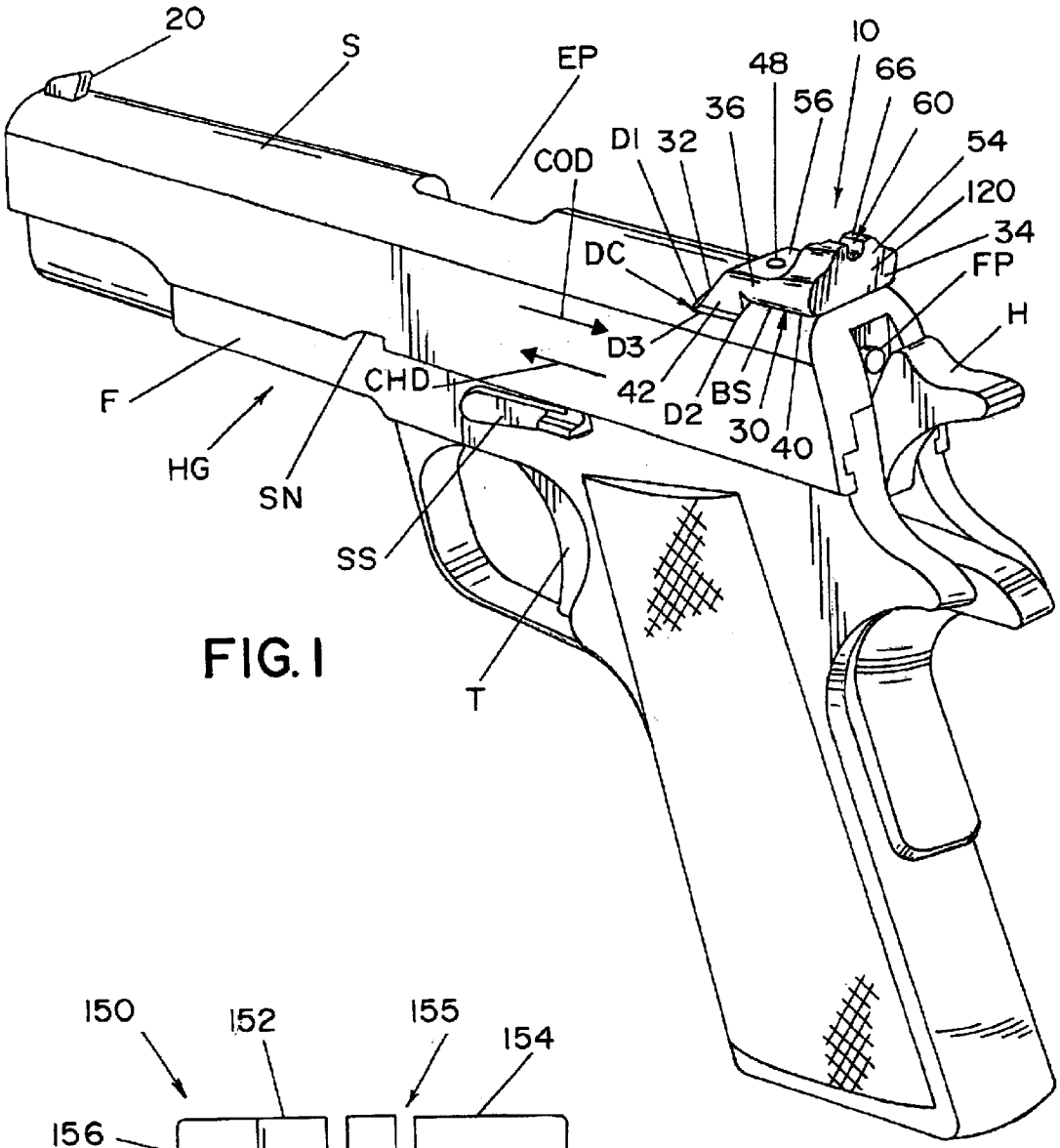
FIG. 1 is a perspective view of a semi-automatic hand gun shown mounted with a tactical gun sight in accordance with the present invention.

Referring now in greater detail to the drawings wherein the showings are for the purpose of illustrating preferred embodiments of the invention only, and not for the purpose of limiting the invention, FIG. 1 shows a semi-automatic handgun HG and slide S with a rear tactical sight 10 and a front tactical sight 20 mounted thereon. A dovetail cut DC and a base surface BS are machined into a portion of the top surface of slide S which allows rear sight 10 to be rigidly secured to slide S and to be precisely oriented relative to a barrel (not shown) for firing accuracy.

Slide S moves relative to a frame F of handgun HG rearwardly in a cocking direction COD to extract and eject a spent cartridge (not shown) from the barrel and to simultaneously cock a hammer H. When this rearward motion is complete, slide S then moves forwardly in a chambering direction CHD to chamber a new round in the barrel. In this respect, when a trigger T is depressed, hammer H pivots forwardly against a firing pin FP which impacts the rear of the chambered round, causing the round to discharge from the barrel. The explosive force of the discharged round, automatically forces slide S rearwardly in cocking direction COD wherein the now spent round is extracted from the chamber and then ejected from an ejection port EP and hammer H is cocked. In addition, a slide recoil spring (not shown) is compressed during this rearward movement. As a result, once slide S has completed it's rearward travel, the now compressed recoil spring produces a forward acting force which urges the slide forward in chambering direction CHD. As slide S is moving forward, it strips a new round from the magazine, feeds that round into the chamber and then seats the round in the chamber, or in one word "chambers" the round. Therefore, if every thing is working properly, each time handgun HG is fired, the spent cartridge is automatically ejected, the hammer is automatically cocked and a new round is automatically chambered in the barrel.

Once all of the rounds are discharged from the magazine, a magazine follower (not shown) is exposed to apply an upward pressure on slide stop SS. As a result, when slide S completes it's rearward most travel in cocking direction COD, a slide stop SS engages and catches a slide stop notch SN thereby retaining slide S in a "locked back" position (not shown). After the empty magazine has been discharged, a full magazine is loaded in handgun HG. The user then depresses slide stop SS and the compressed slide spring forces slide S forward, relative to the frame F, in chambering direction CHD which chambers the top round of the fill magazine.

Turning to FIGS. 2 and 4–8, rear sight 10 includes a base 30 having a front 32 and a back 34 with sides 36 and 38 extending in a longitudinal direction L between front 32 and back 34. Base 30 further includes a bottom 40 having a dovetail 42, which interengages with dovetail cut DC in slide S. Bottom 40 is closely adjacent to base surface BS. The interengagement is facilitated by a front dovetail surface 44 and a rear dovetail surface 46, which slope upwardly towards one another at an angle similar to the angle of the inwardly facing surfaces D1 and D2 of dovetail cut DC. Base 30 further includes a threaded hole 48 centered in the longitudinal direction between surfaces 44 and 46 for accepting a threaded fastener 50. Rear sight 10 is secured to slide S by directing dovetail 42 transversely of direction L into dovetail cut DC a until rear sight 10 is properly aligned with the barrel. Threaded fastener 50 is then threaded into hole 48 until it engages a bottom surface D3 of dovetail cut DC thereby urging dovetail surfaces 44 and 46 upwardly against surfaces D1 and D2 respectively. This rigidly secures sight 10 to slide S and properly aligns sight 10 longitudinally with the barrel. Base 30 further includes a front base surface 52 which is angled rearwardly, a back base surface 54 which is opposite to front surface 52 and a top surface 56 adjacent to front surface 52. The edge between front surface 52 and top surface 56 is broken or softened for clearing a "stove pipe jam" which will be discussed in greater detail below.

Extending upwardly from base 30 are walls which define sight boundaries of a sight line SL for target acquisition and which include a notch 60. More particularly, side walls 62 and 64 extend upwardly from base 30 near base back 34 and are joined by notch wall 66. Side walls 62 and 64, each include outer surfaces 68 and 70, respectively, that are essentially symmetrical to one another and have an inwardly tapered configuration. In this respect, outer surfaces 68 and 70 include a first inwardly extending surface 72 and 74 having a lower edge 76 and 78 adjacent to base sides 36 and 38 respectively. Preferably, first inward surfaces 72 and 74 are radiused with a radius of approximately 0.0625 inches. Outer surfaces 68 and 70 further include a second upwardly extending surface 80 and 82, respectively, adjacent to first surfaces 72 and 74 and which are also arcuate. It is preferred that surfaces 80 and 82 are radiused with a radius of 0.2187 inches. Adjacent to second surfaces 80 and 82 are third surfaces 84 and 86, respectively, which extend inwardly and are arcuate. Preferably, third surfaces 84 and 86 are radiused with a radius of approximately 0.0625 inches. Third surfaces 84 and 86 blend into top surfaces 88 and 90, respectively, which are coplanar with a notch wall top surface 92.

Figure 6:
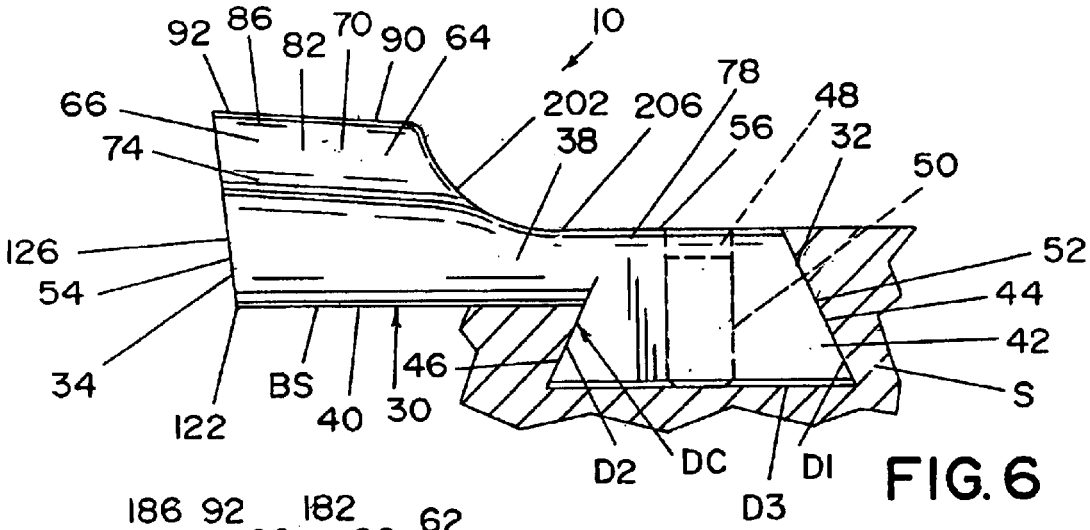
FIG. 6 is a side elevational view of the gun sight shown in FIG. 4.
Figure 7:
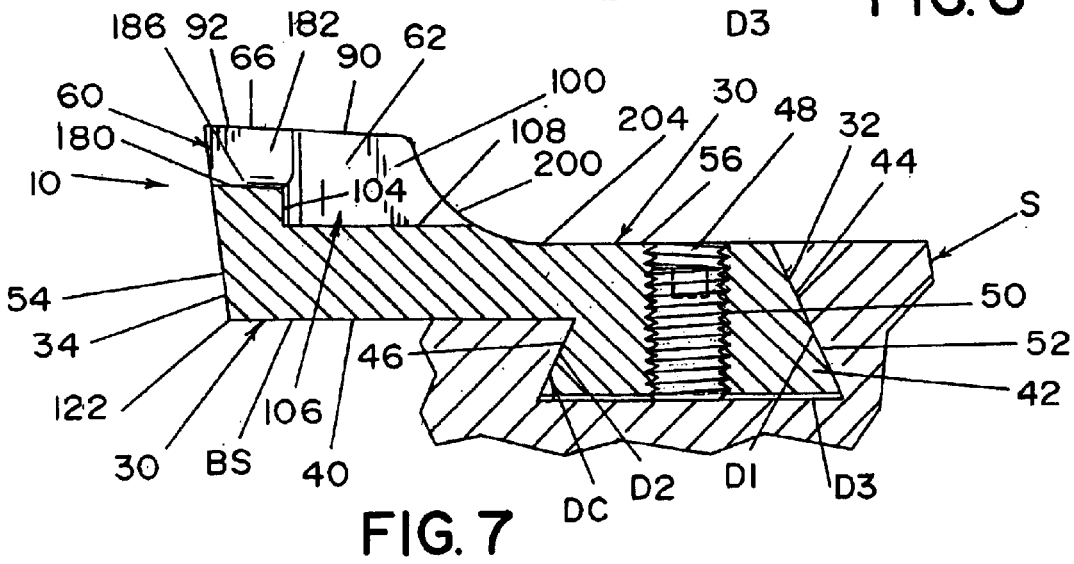
FIG. 7 is a sectional elevational view taken along line 7—7 in FIG. 5.
Figure 8:
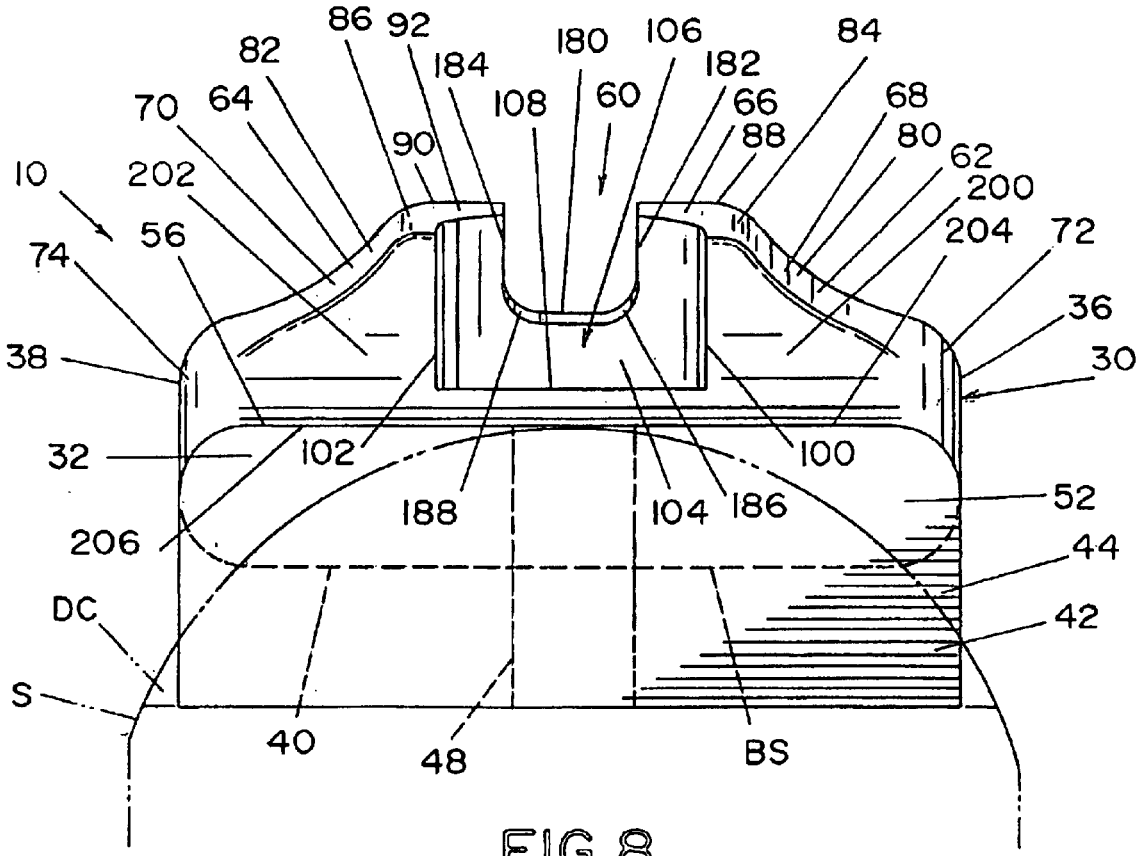
FIG. 8 is a front elevational view of the rear tactical gun sight as shown in FIG. 1.

Referring to FIG. 6, top surfaces 88, 90 and 92 are angled downwardly from rear to front at approximately a 4 degree angle. This 4 degree top slope is provided so that the user does not injure themself when clearing a "stove pipe jam" (SPJ). This slope can be in the range of 0 to 8 degrees. Also, when aligning the sights, this angle gives the user distinct, crisp edges, free of distortion. A flat or horizontal top surface can appear blurry or not easily distinguishable. As stated above, a SPJ involves a spent cartridge, open end up, that failed to be completely ejected from the ejection port EP. The base of the cartridge is resting on the top round in the magazine and it's body is jammed between the slide's breach face (not shown) and the barrel's hood (not shown). Accordingly, the user must then dislodge or clear the spent cartridge so the slide can complete it's forward travel to completely chamber the new round. The "stove pipe" round is cleared by first positioning the user's weak hand's fingers on top of slide S, with the palm facing down so that the stove piped cartridge is between the user's hand and body. Next, with a rapid and forceful motion, the user snaps the positioned hand toward their body so that, the index finger or the palm of the hand, engages the protruding portion of the "stove piped" cartridge. This forceful snapping motion dislodges the cartridge, allowing slide S to travel forward in chambering direction CHD and seat the new round. The force generated by the hand in the above motion and the close proximity to the top of slide S, always carries the hand into and over rear sight 10. The broken or softened edges discussed above and the 4 degree top slant, greatly reduce the likelihood that the user's hand will be injured.

Side walls 62 and 64 further include inwardly facing surfaces 100 and 102, respectively, and notch wall 66 includes a forwardly facing front surface 104 which together form a U-shaped clearance groove or channel cut 106. Forwardly facing front surface 104 can be curved and have a radius of 0.125 inch. With this curved surface 104, clearance groove 106 has a width transverse to said longitudinal direction which is approximately 0.250 inches. Clearance groove 106 is further defined by a clearance groove bottom 108 that is spaced slightly above base top 56. Clearance groove 106, along with notch 60 defines sight boundaries for sight line SL which will be discussed in greater detail below.

Figure 2:
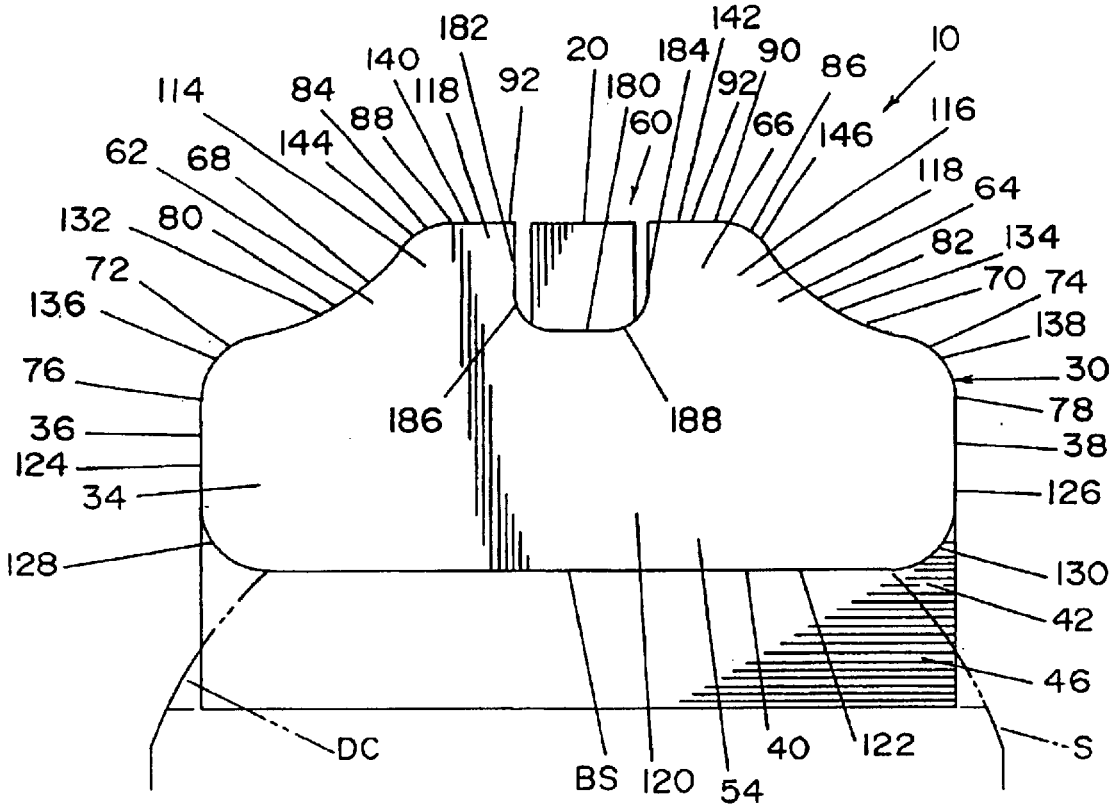
FIG. 2 is an enlarged rear elevational view of the rear sight shown in FIG. 1 in alignment with a front sight.

Sidewalls 62 and 64 and notch wall 66 have back surfaces 114, 116 and 118, respectively, which are contiguous to another and to back surface 54 thereby forming rear sight surface 120 that extends upwardly from base bottom 40 to top surfaces 88, 90 and 92. Preferably, surfaces 114, 116, 118 and 54 are coplanar thereby making surface 120 a flat surface. Referring particularly to FIGS. 2 and 6, rear surface 120 has a rearward slope from bottom to top which is preferably 7 degrees from vertical. However, rear surface 120 can be sloped in the range of 4 to 10 degrees from vertical or in the range of 6 to 8 degrees from vertical. This reduces glare without the use of eye distracting grooves, ridges or other contours. The outer configuration or peripheral edge of sight surface 120 is rounded to minimize the amount of eye distracting corners or sharp edges. In this respect, surface 120 has a bottom edge 122 adjacent base bottom 40 and has side edges 124 and 126 which are adjacent to sides 36 and 38 respectively. Bottom edge 122 is joined to side edges 124 and 126 by arcuate corner edges 128 and 130 respectively. It is preferred that corner edges 128 and 130 are radiused with a radius of 0.0625 inches. However, these arcuate corner edges can have a radius in the range of 0.040 inches to 0.090 inches. Rear surface 120 further includes upper edges 132 and 134 which are adjacent to outer surfaces 68 and 70 respectively. Edges 132 and 134 are joined to side edges 124 and 126 by arcuate corner edges 136 and 138 respectively. As with corner edges 128 and 130, corner edges 136 and 138 are preferably radiused with a radius of 0.0625 inches. These corner edges can have a radius in the range of 0.040 inches to 0.090 inches. Also, while the radius of corner edges 128, 130, 136 and 138 can vary, it is preferred that they are equal to each other. Rear surface 120 further includes top edges 140 and 142 which are preferably horizontal and in line with one another. Edges 140 and 142 are blended into edges 132 and 134, respectively, by arcuate edges 144 and 146 respectively. The result is that edges of rear surface 120 are flowing and direct the user's eye toward notch 60.

Figure 3:
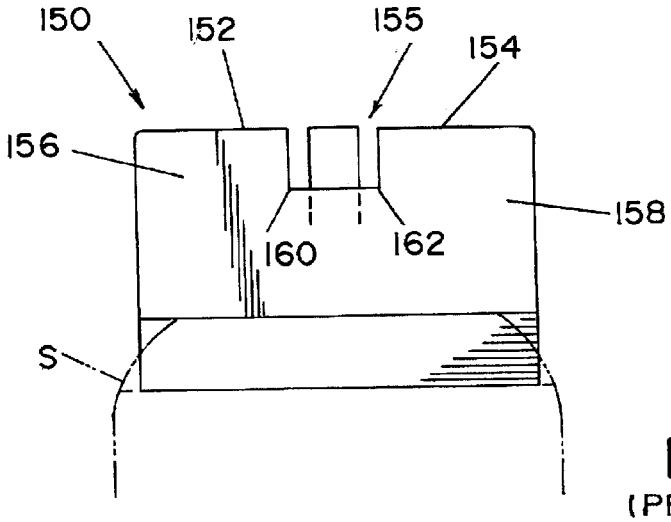
FIG. 3 (PRIOR ART)
FIG. 3 is a rear elevational view of a prior art gun sight in alignment with a front sight.

Due to the inward taper of outer surfaces 68 and 70, rear surface 120 is very narrow near top edges 140 and 142 to prevent the user from having to spend time searching the top edge of the rear sight for the target or for the front sight. More particularly, referring to FIG. 3, a prior art sight 150 is shown. As can be seen, prior art sight 150 includes substantial top edges 152 and 154 which forces the user to spend time searching the top edge for the front sight or notch 155. In addition, by including rectangular side walls 156 and 158 a substantial amount of the user's vision is blocked. This also increases the amount of time it takes the user to both find the front sight and to acquire a view of the target which under tactical situations can be deadly.

Figure 4:
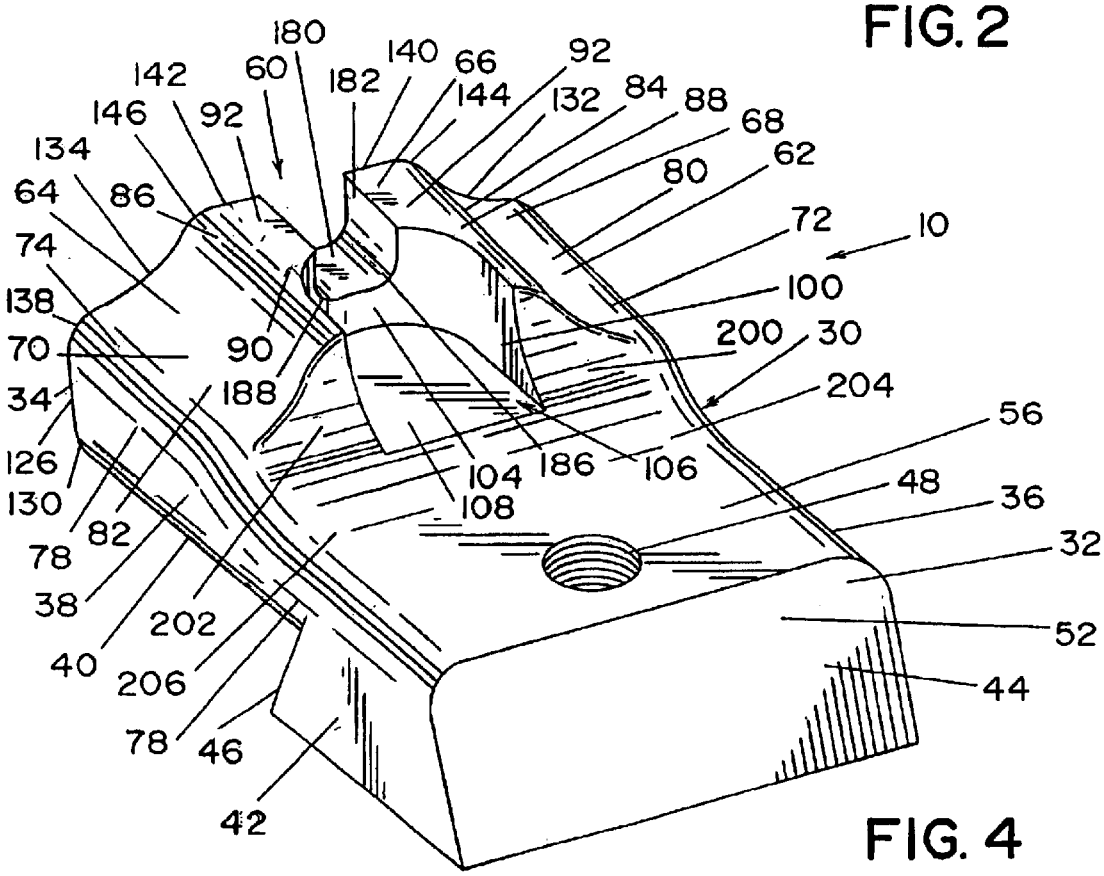
FIG. 4 is a detached perspective view of a rear tactical gun sight according to the present invention.
Figure 5:
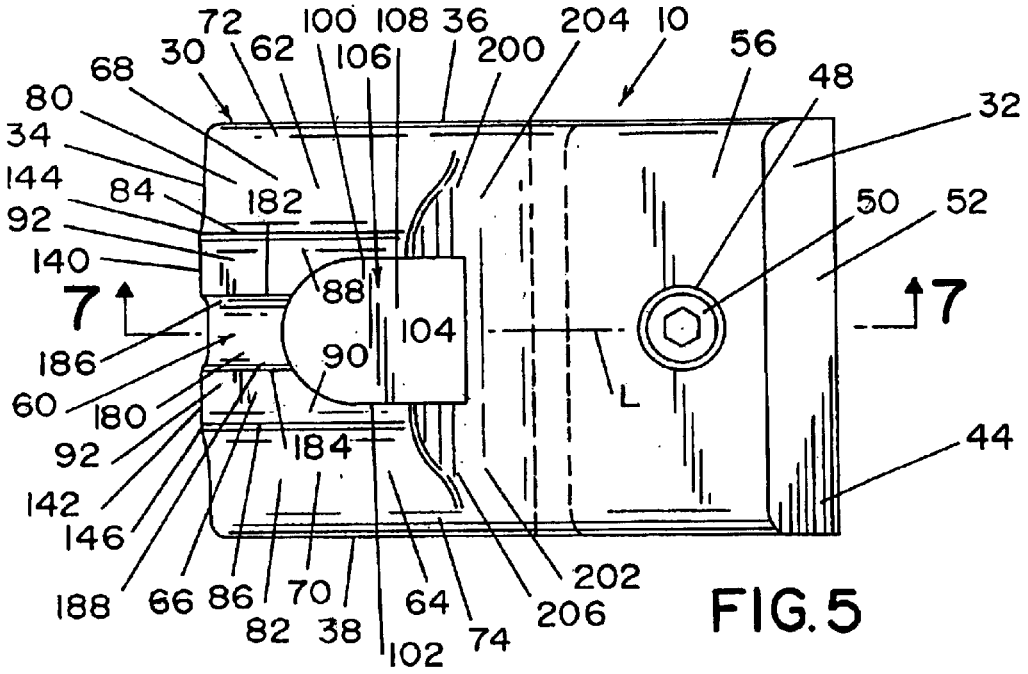
FIG. 5 is a top plan view of the gun sight shown in FIG. 4.

Referring to FIGS. 2 and 4, Notch 60 of the invention of this application is an upwardly opened notch, which is centered horizontally in rear surface 120. Notch 60 is defined by a notch base surface 180 which is essentially horizontal and notch side surfaces 182 and 184 that are essentially vertical. Notch base 180 is joined to notch sides 182 and 184 by arcuate corner portions 186 and 188 respectively. It is preferred that corner portions 186 and 188 are radiused having a radius of 0.0469 inches. However, corner portions 186 and 188 can be radiused in the range of 0.030 inches to 0.060 inches. Base 180 is a planar surface that is slightly angled from back to front. The slight angle from back to front produces a crisp, well defined notch base as the user looks through notch 60 towards front sight 20. In addition, as discussed above, top surfaces 88, 90 and 92 are also angled downwardly from back to front which not only prevents injury while clearing a "stove pipe jam," but also produces a clear, crisp and distinct edge for the user when looking through rear sight 10, toward front sight 20. Furthermore, the shooters could be distracted by seeing a horizontal plane on the top of sight 10. Notch 60 has a width transverse to the longitudinal direction, between sides 182 and 184, of preferably 0.125 inches and a length in the longitudinal direction which is preferably 0.125 inches. As will be discussed in greater detail below, by reducing the notch length to 0.125 inches, as compared to prior art sights, sight boundaries are further reduced.

Comparing prior art site notch 155 to notch 60 of this application shows one aspect of why sight 10 of this application allows the user to more quickly obtain target acquisition and sight alignment. In this respect, aligning sights 10 and 20 on a target involves aligning the front and rear sights horizontally and vertically. With respect to horizontal alignment prior art sight 150 includes square corner edges 160 and 162. Conversely, sight 10 includes arcuate corners, portions 186 & 188, which assist the user by directing the user's eye upward to front sight 20. This provides the user with a better frame of reference, by directing the vision upward to the top of notch 60 and the top of front sight 20.

Prior art notches which are semicircular (not shown) are also difficult to align horizontally due to the judgment necessary to determine whether the front sight is centered. By not including vertical sidewalls, the user has no, or substantially diminished, side references to align the front sight in the rear notch and also to adjust for windage. Also, during the process of "breaking the shot," which refers to the process of maintaining sight alignment while the trigger is being pressed if pressure is not evenly applied to the trigger, sight misalignment can occur. More particularly, if the trigger press is not exactly straight back in that it is applied to either side of the trigger, the pressure is transferred throughout the handgun. This often results in handgun HG becoming misaligned and the shot being off. However, by including vertical side walls, the user is better able to observe that something is going wrong in that the sights are out of alignment and, therefore, can adjust accordingly. Turning to vertical alignment, notch 60 includes base 180 which is flat to help with vertical alignment by providing a reference with the top of front sight 20. In addition, sights 10 and 20 are aligned vertically when the top edge of the front sight is in alignment with edges 140 and 142.

Side walls 62 and 64 further include forwardly facing surfaces 200 and 202, respectively, which are arcuate and preferably are radiused with a radius of 0.219 inches. However, this radius can range between 0.175 inches and 0.300 inches or preferably in the range of 0.200 inches to 0.250 inches. Surfaces 200 and 202 have a forward or leading edge 204 and 206, respectively, adjacent top surface 56. It is preferred that surfaces 200 and 202 blend into top surface 56. In addition, surfaces 200 and 202 are a unified surface below clearance groove bottom 108 which is spaced slightly above top surface 56. However, it should be noted that bottom 108 could be coplanar with or essentially an extension of top surface 56.

In order to protect the user while clearing a "stove pip jam" also discussed above in detail, the edges between forward facing surface 200 and outer surface 68, and between surface 200 and surface 88 are soften or broken. In similar fashion, the edges between forward facing surface 202 and outer surface 70, and between surface 202 and surface 90 are also soften or broken.

Figure 9:
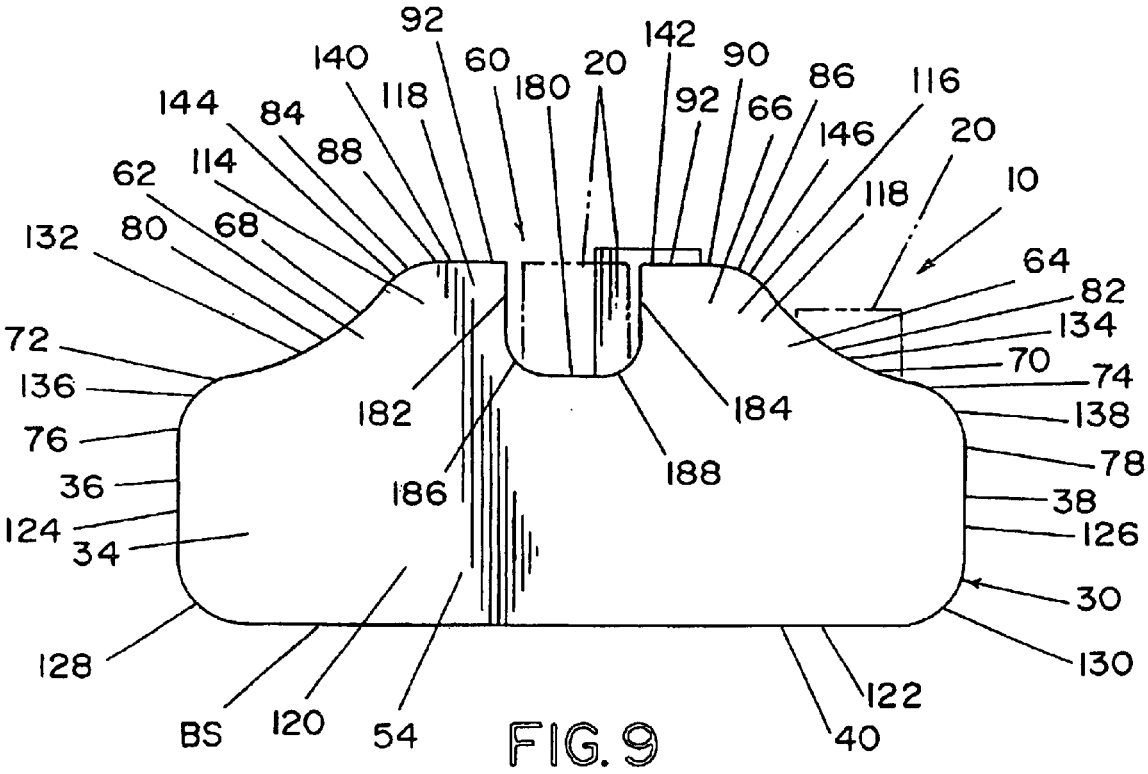
FIG. 9 is a rear view of the rear tactical gun sight according to the present invention along with the front sight showing the alignment of the sights for target acquisition.
Figure 10A:
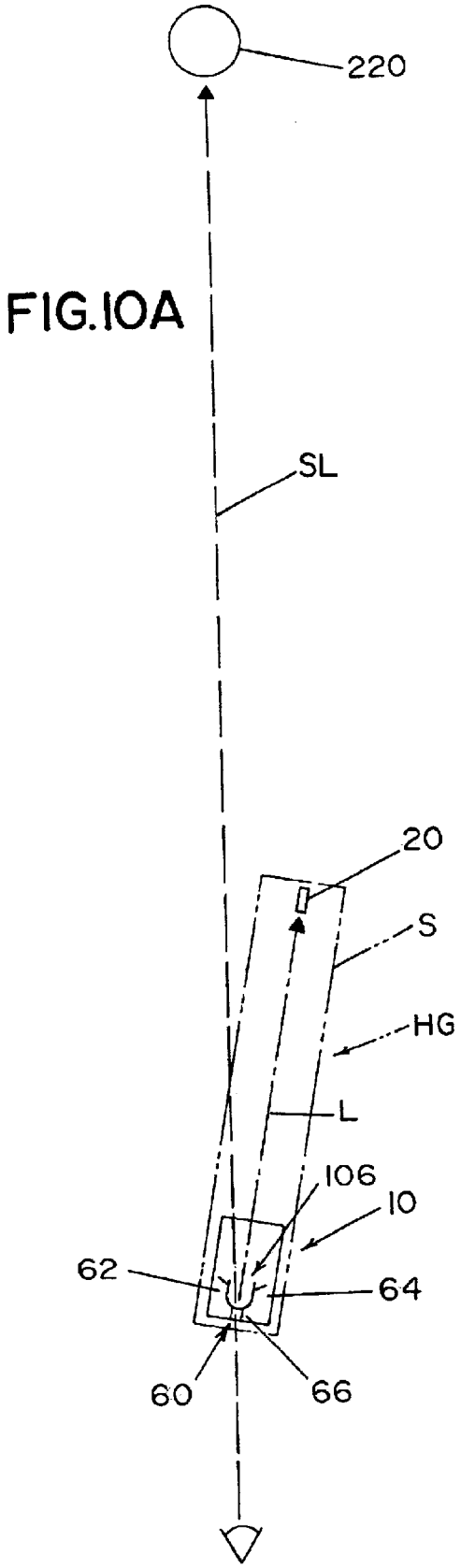
FIG. 10A is a schematic top view of the gun sight shown in FIG. 1 showing a sight line of the user; and, FIG. 10B is a top view similar to FIG. 10A showing another sight line of the user and target acquisition.
Figure 10B:
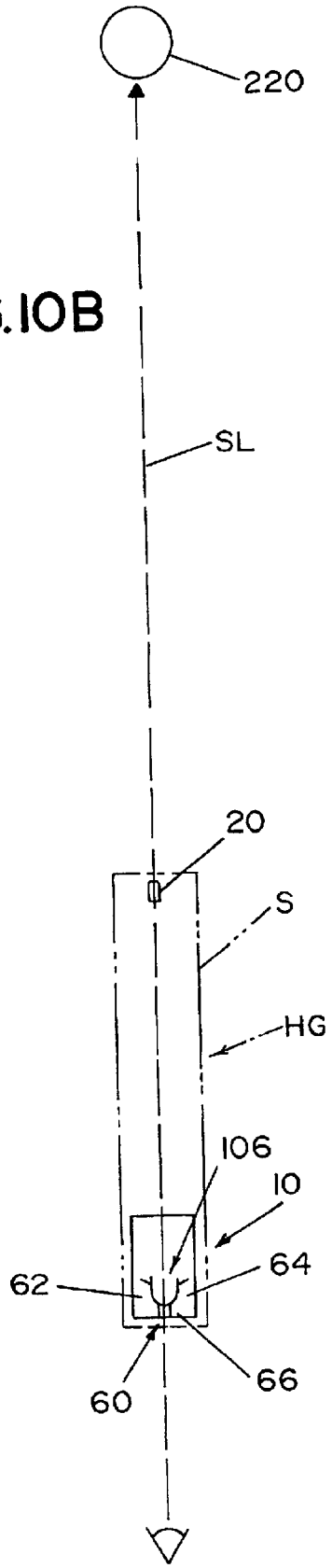

Referring to FIGS. 9, 10A and 10B, shown are examples of sight boundaries and the alignment of front sight 20, rear sight 10 and target 220. Starting with the sight boundaries within notch 60, the sight line SL is bound, in part, by the inner configuration of walls 62, 64 and 66. In this respect, if the user is looking through notch 60 toward front sight 20, the user can only see target 220 if a straight line can be drawn between the user's eye and target 220. Any obstruction of that line will prevent user from seeing the target. By shortening the length of notch 60 and by including clearance groove 106, even though hand gun HG in FIG. 10A is well out of line with target 220, target 220 can be seen by the user through notch 60. If either the notch length was increased or the clearance groove was removed, the user would not be able to see target 220 through notch 60 with the misalignment shown in FIG. 10A. As a result, sight acquisition time would increase. Turning to the outer configuration and FIG. 9, by having a small top edges 140 and 142 and tapered edges 132 and 134, either the front sight or target 220 can be easily seen by the user about side and notch walls 62, 64 and 66. Even if front sight 20 is below and off to the side of rear sight 10, the user will be better able to see the front sight and therefore be able to more quickly bring front sight 20 into proper alignment within notch 60. In addition, if front sight 20 is over the top edge of rear sight 10, by having a small top edge, the user will be able to more quickly bring the front sight 20 into alignment within notch 60. It should be appreciated that while FIG. 9 shows only front sight 20, in similar fashion, the configuration of rear sight 10 also helps the user view target 220 if it is in a similar relation to rear sight 10.

While considerable emphasis has been placed on the preferred embodiments of the invention illustrated and described herein, it will be appreciated that other embodiments can be made and that many changes can be made in the preferred embodiments without departing from the principles of the invention. Accordingly, it should be distinctly understood that the foregoing descriptive matter is to be interpreted merely as illustrative of the invention and not as a limitation.

What is claimed is:

1. A rear tactical sight for a semi-automatic handgun having a barrel and a slide which moves relative to the barrel rearwardly in a cocking direction to extract and eject a spent cartridge, and cock the hammer and then forwardly in a chambering direction to chamber the next round, said sight comprising a base extending in a longitudinal direction parallel to the cocking and chambering directions, said base having a back facing the cocking direction, a front facing the chambering direction, sides extending in said longitudinal direction and a bottom having a dovetail for interengaging with the slide to maintain said sight relative to the slide; said sight further includes a pair of spaced apart side walls extending upwardly from said base sides and a notch wall extending between said side walls and which includes an upwardly opened notch having a notch length in said longitudinal direction and a notch width transverse to said notch length substantially equal to said notch length, said notch partially defining boundaries of a sight line for said sight, said side walls and said notch wall having back surfaces which are contiguous with one another and with said base back and together with said base back forming a rear sight surface extending upwardly from said base bottom, said notch wall having a front surface and said side walls having inwardly facing surfaces spaced from one another on either side of said sight line, said inwardly facing surfaces and said notch wall front surface defining a clearance groove which further defines said sight line boundaries.

2. The rear tactical sight of claim 1, wherein said notch is an upwardly opened notch having a substantially horizontal notch base transverse to said longitudinal direction and substantially vertical notch sides adjacent either side of said notch base, said notch sides being joined to said notch base by symmetrical arcuate corner surfaces.

3. The rear tactical sight of claim 2, wherein said notch corner surfaces are radiused and have a radius between 0.030 inches and 0.060 inches.

4. The rear tactical sight of claim 3, wherein said notch has a notch length in said longitudinal direction and a notch width transverse to said notch length, said notch width and notch length being approximately 0.125 inches.

5. A rear tactical sight for a semi-automatic handgun having a barrel and a slide which moves relative to the barrel rearwardly in a cocking direction to extract and eject a spent cartridge, and cock the hammer and then forwardly in a chambering direction to chamber the next round, said sight comprising a base extending in a longitudinal direction parallel to the cocking and chambering directions, said base having a back facing the cocking direction, a front facing the chambering direction, sides extending in said longitudinal direction and a bottom having a dovetail for interengaging with the slide to maintain said sight relative to the slide; a notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface includes a first surface extending upwardly and inwardly from a corresponding one of said base sides respectively and a second surface extending upwardly from said first surface such that said first surface has a lower edge adjacent to a corresponding one of said base sides and extending inwardly toward an upper edge adjacent to a respective lower edge of said second surface.

6. The rear tactical sight of claim 5, wherein said each side wall further includes a third surface extending inwardly from said second surface such that said second surface has an upper edge adjacent to a corresponding one of said third surfaces.

7. A rear tactical sight for a semi-automatic handgun having a barrel and a slide which moves relative to the barrel rearwardly in a cocking direction to extract and eject a spent cartridge, and cock the hammer and then forwardly in a chambering direction to chamber the next round, said sight comprising a base extending in a longitudinal direction parallel to the cocking and chambering directions, said base having a back facing the cocking direction, a front facing the chambering direction, sides extending in said longitudinal direction and a bottom having a dovetail for interengaging with the slide to maintain said sight relative to the slide; a notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface includes a first inwardly extending surface and a second upwardly extending surface, said first surface having a lower edge adjacent to a corresponding one of said base sides and an upper edge adjacent to a respective lower edge of said second surface, a third inwardly extending surface; said second surface having an upper edge adjacent to a corresponding one of said third surfaces, said first second and third surfaces are arcuate surfaces and said each side wall further includes a top surface which is generally parallel to the barrel axis and adjacent to said third surfaces.

8. The rear tactical sight of claim 7, wherein said first, second and third surfaces are radiused and said first and third surfaces have a radius of approximately 0.0625 inches and said second surface has a radius of 0.2187 inches.

9. The rear tactical sight of claim 7, wherein said base back is a bottom portion of a rear sight surface having a bottom edge adjacent said base bottom and upwardly extending side edges adjacent said base sides, said bottom edge and said side edges being joined by arcuate corner edges.

10. The rear tactical sight of claim 7, wherein said sight further includes a notch wall extending between said side walls, said side walls and said notch wall having back surfaces which are contiguous with one another and with said base back and together with said base back forming a rear sight surface extending upwardly from said base bottom and between said base sides, said rear sight surface including a bottom edge adjacent said base bottom and upwardly extending side edges adjacent said base sides, said bottom edge and said side edges being joined by first arcuate corner edges, said rear sight surface further including upper edges adjacent said side wall outer surfaces, said upper edges and said side edges being joined by second arcuate corner edges.

11. The rear tactical sight of claim 10, wherein said first and second arcuate corner edges are radiused with a radius between 0.040 inches and 0.090 inches.

12. The rear tactical sight of claim 10, wherein said arcuate corner edges are radiused with a radius between 0.040 inches and 0.090 inches.

13. A rear tactical sight for a semi-automatic handgun having a barrel and a slide which moves relative to the barrel rearwardly in a cocking direction to extract and eject spent cartridge, and cock the hammer and then forwardly in a chambering direction to chamber the next round, said sight comprising a base extending in a longitudinal direction parallel to the cocking and chambering directions, said base having a front facing the chambering direction, sides extending in said longitudinal direction, a bottom having a dovetail for interengaging with the slide to maintain said sight relative to the slide, and a back facing the cocking direction, said base back being a bottom portion of a rear sight surface having a bottom edge adjacent said base bottom and side edges adjacent said base sides, said bottom edge and said side edges being joined by arcuate corner edges, a notch joined to said base and spaced above said base bottom which at least partially defines boundaries of a sight line for said sight said arcuate corner edges are radiused with a radius between 0.040 inches and 0.090 inches.

14. A rear tactical sight for a semi-automatic handgun having a barrel and a slide which moves relative to the barrel rearwardly in a cocking direction to extract and eject a spent cartridge, and cock the hammer and then forwardly in a chambering direction to chamber the next round, said sight comprising a base extending in a longitudinal direction parallel to the cocking and chambering directions, said base having a front facing the chambering direction, sides extending in said longitudinal direction, a bottom having a dovetail for intereneaging with the slide to maintain said sight relative to the slide, and a back facing the cocking direction, said base back being a bottom portion of a rear sight surface having a bottom edge adjacent said base bottom and side edges adjacent said base sides, said bottom edge and said side edges being joined by arcuate corner edges, a notch joined to said base and spaced above said base bottom which at least partially defines boundaries of a sight line for said sight said sight further includes a pair of side walls extending upwardly from said base on either side of said sight line, a notch wall extending between said side walls, said side walls and said notch wall having back surfaces which are contiguous with one another and with said base back and said rear sight surface, said arcuate corner edges being first arcuate corners and, said rear sight surface further including upper edges adjacent said side wall outer surfaces, said upper edges and said side edges being joined by second arcuate corner edges.

15. The rear tactical sight of claim 14, wherein said first and second arcuate corner edges are radiused with a radius between 0.040 inches and 0.090 inches.

16. A rear tactical sight for a semi-automatic handgun having a barrel and a slide which moves relative to the barrel rearwardly in a cocking direction to extract and eject a spent cartridge, and cock the hammer and then forwardly in a chambering direction to chamber the next round, said sight comprising a base extending in a longitudinal direction parallel to the cocking and chambering directions, said base having a back facing the cocking direction, a front facing the chambering direction, sides extending in said longitudinal direction and a bottom having a dovetail for interengaging with the slide to maintain said sight relative to the slide; said sight further includes a pair of spaced apart side walls extending upwardly from said base sides and a notch wall extending between said side walls and which includes an upwardly opened notch having a notch length in said longitudinal direction and a notch width transverse to said notch length generally equal to said notch length, said notch partially defining boundaries of a sight line for said sight, said side walls and said notch wall having back surfaces which form a portion of a rear sight surface that extends upwardly from said base bottom, said notch wall having a front surface and said side walls having inwardly facing surfaces spaced from one another on either side of said sight line, said inwardly facing surfaces and said notch wall front surface defining a clearance groove which further defines said sight line boundaries.

* * * * *